United States Patent [19]

Jessup

[11] 4,178,719

[45] Dec. 18, 1979

[54] CENTERLESS GRINDING MACHINE

[75] Inventor: Wilbur F. Jessup, The Hague, Netherlands

[73] Assignee: Cincinnati Milacron Inc., Cincinnati, Ohio

[21] Appl. No.: 926,316

[22] Filed: Jul. 20, 1978

[51] Int. Cl.[2] ..... B24B 5/18

[52] U.S. Cl. ..... 51/103 TF; 51/103 R; 51/289 R

[58] Field of Search ..... 51/80 A, 88, 103 R, 51/103 C, 103 WH, 103 TF, 281 R, 289 R, 215 SF, 33 W

[56] References Cited

U.S. PATENT DOCUMENTS

| | | | |
|---|---|---|---|
| 1,210,937 | 1/1917 | Heim | 51/103 TF |
| 1,611,135 | 12/1926 | Sanford | 51/103 WH |
| 1,669,728 | 5/1928 | Vanderbeek | 51/103 WH |
| 3,408,773 | 11/1968 | Cole et al. | 51/103 R |
| 4,107,881 | 8/1978 | Jessup | 51/103 TF X |

*Primary Examiner*—Gary L. Smith
*Assistant Examiner*—Robert P. Olszewski
*Attorney, Agent, or Firm*—Thomas M. Farrell

[57] ABSTRACT

A centerless grinder for shaping bars during a through-feed grinding operation. A special centerless grinder is adapted to receive a workpiece at an inlet end between the regulating and grinding wheels and to discharge the workpiece at an exit end between the wheels while a special pivoting mechanism is provided to relatively pivot the wheels with respect to one another about a pivot point proximate the wheel inlet end. The relative pivoting movement of the wheels is performed in timed relationship to the through-feed movement of the workpiece, so that the exit spacing of the wheels determines the final, exiting, diameter of the workpiece at a given time. Therefore, varying cross-sectional diameters of a workpiece may be achieved along a work axis by appropriate timed movement of the wheels.

5 Claims, 9 Drawing Figures

CENTERLESS GRINDING MACHINE

BACKGROUND OF THE INVENTION

In the automobile industry, "progressive springs" for small automobiles, are coiled from tapered bars, so that the "ride" for four people in a small car is essentially the same as for one person. Some bars may be tapered in one direction for the entire length, and other bars may have symmetrical, or reverse tapers at opposing ends. One example of such springs is depicted in U.S. Pat. No. 4,077,619. The bars may be produced by several conventional bar forming processes, but to produce the size and finish required for performance and fatigue life, grinding is the preferred process for manufacturing. Ideally, these bars should be taper-turned then ground for the final operation before going into the coiling furnace, because turning inevitably introduces a serious compromise between efficient utilization of power and good surface finish, whenever finish is an important parameter of the operation. Turning, however, may become a problem when it becomes necessary to remove large amounts of stock from relatively small diameter bars, as will be the case when turning the small diameter of a tapered bar. This comes from the fact that the torque must be absorbed in "wind-up" of the bar, which limits the amount of horsepower that can be applied. It therefore becomes of paramount interest to consider grinding spring bars from the solid on a production basis. The centerless grinder has enjoyed great success in its duty as a high volume production machine, but prior art centerless grinder configurations are generally unsuitable to perform the task of generating spring bar cross-sections on a production-type through-feed grind set-up.

For the last 25 or 30 years, tapered fishing rods have been ground on a centerless grinder. On these rods, the taper is generated by synchronizing the infeed movement of the standard slide with the thrufeed rate produced by the regulating wheel rotation and feed angle. This basic concept could just as well be applied to grinding tapered steel bars, except for a fundamental difference in the behavior of a grinding wheel when it is grinding plastic impregnated fiberglass material and when it is grinding steel. When grinding plastic rods, the wheel does not wear significantly, even when grinding an extreme taper out of a cylindrical blank. In most steel bar grinding, in order to minimize the machine cost of the operation, we must use wide wheels and high stock removals. The high stock removals result in relatively high rates of wheel wear (G-ratios, i.e. the ratio of stock removal to wheel wear, of "6" are considered quite good and are frequently much less). Consequently, "self-dressing" wheels are used, because the time of the dressing operation on wide wheels, the frequency due to the high wheel wear rates, and the cost of diamonds, make diamond dressing prohibitively expensive.

A self-dressing grinding wheel is a wheel which, because of its construction, during grinding exhibits uniform, continuous, controlled breakdown of the grinding surface to present sharp cutting elements continuously during the grinding operation.

On fishing rod grinders, where the wheel axes remain parallel during the slide infeed, both wheels are profiled, with one part of the profile removing the material and the other parts generating the surfaces on the tapered and on the straight portions of the rod. If this straight infeed method were used for grinding steel, the wear action could so quickly deteriorate the wheel profile that in a matter of minutes redressing would be required, and the operation could not possibly prove viable.

Applicant has obviated the difficulties inherent in the prior art design by a novel grinding apparatus and method.

It is therefore an object of the present invention to provide a machine structure capable of producing tapered spring bars on a through feed centerless grinding setup.

Another object of the present invention is to provide a centerless grinding machine structure capable of generating varied workpiece cross-section diameters by relative pivotal movement of regulating and grinding wheels in timed relationship to through-feed movement of a workpiece.

SUMMARY OF THE INVENTION

A special centerless grinder adapted to receive a workpiece at an inlet end between regulating and grinding wheels and to discharge the workpiece at an exit end between the wheels. The grinding wheel is rotatably journaled in a grinding wheelhead on a base and the regulating wheel is rotatably journaled in regulating wheelhead on said base and disposed with a special pivoting mechanism to relatively pivot the wheels with respect to one another about a pivot point proximate the wheel inlet end. The pivot mechanism is operable to achieve variable feed distances along the face of the regulating wheel relative to said grinding wheel, in timed relationship to the through-feed movement of a workpiece so as to achieve variable cross-sectional diameters of a workpiece of revolution along a work axis by appropriate timed movement of the wheels.

DESCRIPTION OF THE PREFERRED EMBODIMENT

Figure 1:
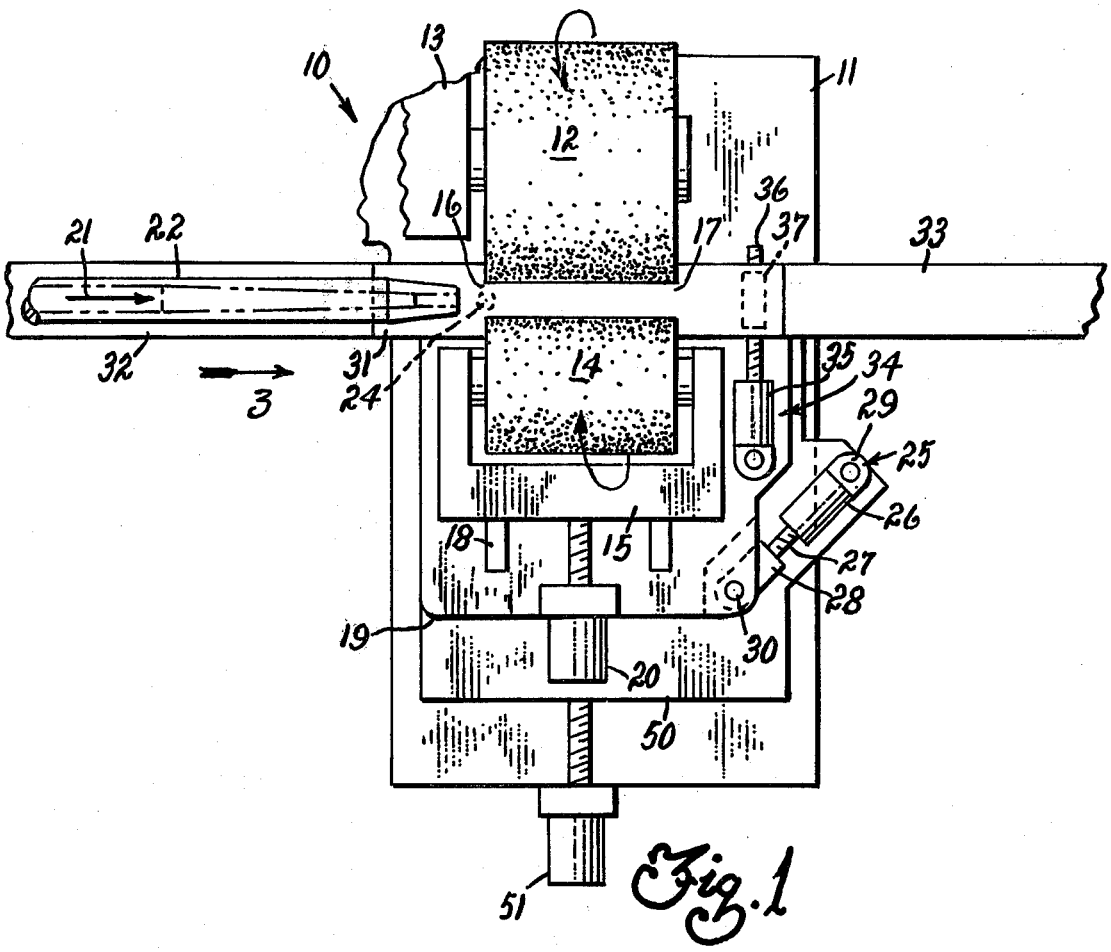
FIG. 1 is a plan view of a centerless grinder of the present invention.

Referring now to the drawings and particularly to FIG. 1 thereof, there is shown a centerless grinding machine 10 of the present invention, having a base 11 carrying a grinding wheel 12 which is rotatably journaled in a grinding wheelhead 13 carried on said base 11. A regulating wheel 14 is rotatably journaled in a regulating wheelhead 15 carried on said base 11 and disposed relative to the grinding wheel 12 to form an inlet end 16 and an outlet end 17 between the wheels 12,14. The regulating wheelhead 15 is slidably carried on ways 18 on a subbase 19, and a suitable feed means, such as the motor/screw assembly 20 mounted on the subbase 19, is provided to move the regulating wheel 14 into desired proximity of the grinding wheel 12 as is conventionally known to do in the art, for set-up purposes and the like.

While not depicted, the regulating wheel 14 is pivotally tilted into the plane of the paper as viewed in FIG. 1, to provide a slight through-feed vector 21 when performing a through-feed grind operation, in a manner well-known in the art for achieving axial movement of a workpiece 22. The subbase 19 is pivotally mounted to the upper surface 23 of a wheelslide 50, and is journaled at a pivot joint 24 in the wheelslide 50 proximate to the inlet end of the wheels 12,14. The wheelslide 50 is powered relative to the base 11 by a motor/screw assembly 51 since it is necessary that the entire swivelling mechanism be incorporated into a slide unit that can be carried forward as an entity to follow the grinding wheel wear. The pivot joint 24 is detailed in FIG. 3, but any suitable pivot arrangement is acceptable. The subbase 19 is constrained from all but arcuate movement about the pivot joint 24. To provide pivot movement to the subbase 19, a pivot feed means 25 such as the motor 26-screw 27-nut 28 combination is depicted, wherein the screw 27 is axially fixed with respect to the slide 50; the nut 28 is axially movable relative to the slide 50; and the motor 26 is adapted to a clevis mount 29 on the slide 50 and the nut 28 is adapted to a clevis mount 30 on the subbase 19. By the push-pull arrangement depicted as the pivot feed means 25, the subbase 19 may be pivoted to provide relative pivot movement between the wheels 12,14, thereby creating varied dimensions between the wheels 12,14, at the wheel exit end 17.

It may readily be appreciated that a workpiece 22 which is through-feed ground between the wheels 12,14, may be shaped with varying cross-sectional dimensions by varying the exit dimension between the wheels 12,14. The workpiece formation, therefore, may be analogized to an extrusion emanating from a die orifice.

A work support assembly 31 supports the workpiece during its travel between the wheels 12,14, in a manner well-known in centerless grinding art, and the workpiece 22 is received from a first support table 32 proximate to the work support assembly 31 and a second table 33 receives the work that is discharged from the work support assembly 31. In special cases where the relative pivotal movement of the wheels is very slight, it may be sufficient to leave the work support assembly stationary when shaping the workpiece 22. However, to be precise, it is preferable that the work support assembly 31 be movable so that it is parallel to the axis of the workpiece 22 at all times, and that it bisects the angle formed between the wheels 12,14. For this movement of the work support assembly 31, the assembly 31 may be journaled around the pivot joint 24 in a fashion similar to the junction of the subbase 19 at the pivot joint 24, and the work support assembly 31 is pivoted through an angle which is one-half the angle through which the subbase 19 is pivoted. To accomplish the pivoting movement of the work support assembly 31, a work support pivot means 34 is depicted as a motor 35-screw 36-nut 37 assembly in which the motor 35 is clevis-mounted to the subbase 19, and the screw 36 is axially movable in a nut 37 (dotted) which is gimbal-mouunted in the work support assembly 31 so that as the subbase pivot means 25 is powered, the work support assembly pivot means 35 may be powered in a predetermined proportion calculated to properly orient the work support assembly to the workpiece during its excursion. It may be appreciated that other pivot mechanisms may be employed, for example; gearing to pivot the work support one-half as much as the subbase movement, or; a suitable angle bisecting linkage.

Figures 2A, 2B, 2C, 2D, 2E, 2F, 2G:
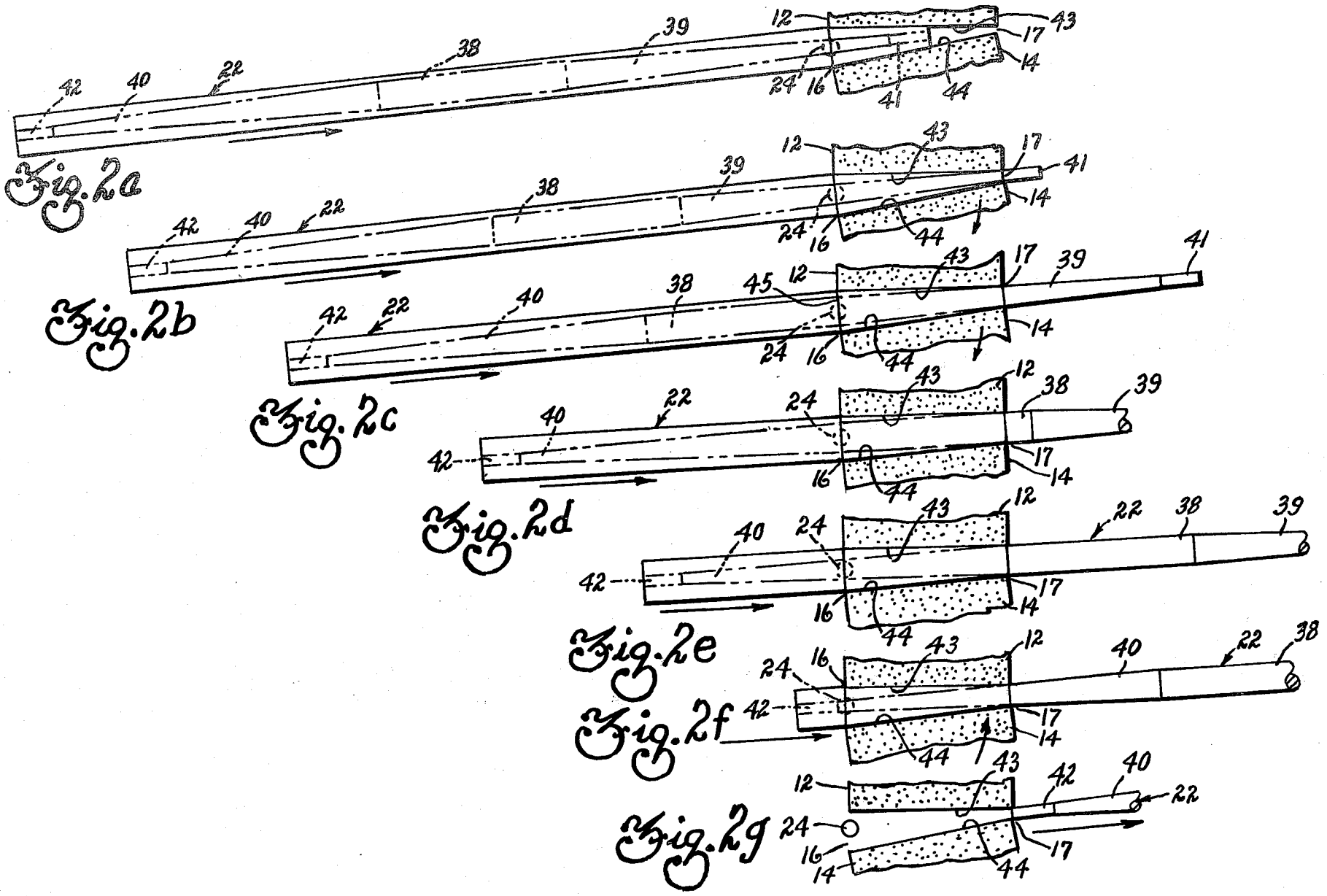
FIG. 2*a* is a diagrammatic view of a workpiece being shaped with a leading taper on a centerless grinder.
FIG. 2*b* is a continuation of the leading taper formation of FIG. 2*a*.
FIG. 2*c* is a conclusion of the leading taper formation of FIG. 2*a*.
FIG. 2*d* is a diagrammatic view of a straight diameter formation of a workpiece during through-feed grinding on a centerless grinder.
FIG. 2*e* is the beginning formation of the trailing taper of the workpiece of FIG. 2*a*.
FIG. 2*f* is a continuation of the trailing taper formation of FIG. 2*e*.
FIG. 2*g* is a conclusion of the trailing taper formation of FIG. 2*e*.

FIG. 2*a* depicts in diagrammatic form, a workpiece 22 having a straight central section 38, and opposing tapers 39,40, at the respective ends, together with straight diameter portions 41,42, at the extreme ends. The regulating wheel 14 is pivoted about the pivot joint 24 so that the exit end 17 of the wheels 12,14 is spaced to the desired diameter of the straight portion 41, and, it may be seen that while the workpiece taper 39 is very long and gradual, as compared to the rather abrupt divergence of the wheel faces 43,44, towards the exit end 17, a rough reduction in diameter occurs rapidly on the workpiece 22 as it is propelled in the direction of the arrow. FIG. 2*b* illustrates that the regulating wheel 14 is to begin movement away from the grinding wheel 12 as the start of the gradual taper 39 reaches the exit end 17 of the wheels, and it can be seen that the straight portion 41 diameter of the workpiece 22 has been formed by the relatively stationary position of the wheels in FIG. 2A. The regulating wheel 14 is moved in the direction of the arcuate arrow as the workpiece 22 is propelled in the direction of the through-feed arrow, thereby steadily increasing the diameter of the workpiece 22 along the gradual taper 39, in timed relation to the through-feed movement. FIG. 2*c* illustrates the wheel position as the end 45 of the first gradual taper 39 reaches the inlet end 16 of the wheels 12,14, at which time, it is seen that the regulating wheel 14 is still moving about the pivot joint 24 in the direction of the arcuate arrow to place the wheel faces 43,44 more nearly parallel to one another, so that the straight central section 38 of the workpiece may be centerless ground in through-feed fashion in the conventional manner of FIG. 2*c*, i.e. the wheels 12,14 are not pivotally moved relative to one another during the grinding of the straight section 38.

FIG. 2*e* depicts the workpiece 22 immediately after the straight section 38 has left the exit end 17 of the wheels 12,14, and the machine is to commence grinding the trailing gradual taper 40. At this time, the regulating wheel 14 is pivotally fed towards the grinding wheel 12 in the direction of the arcuate arrow of FIG. 2*f*, which depicts an intermediate stage while the trailing taper 40 is being formed, and it may be seen that the workpiece 22 is ground from a solid, thereby creating an hourglass shape to the workpiece 22 at the instant depicted in FIG. 2*f*. It should be remembered, however, that FIG. 2*f* is an instantaneous position in a dynamic scheme, i.e., the workpiece 22 is continually flowing in the direction of the through-feed arrow while the regulating wheel 14 is simultaneously being fed in the direction of the arcuate arrow. In FIG. 2*g*, the workpiece 22 is seen exiting the wheels 12,14 (all pivotal movement being stopped) at the end of the trailing gradual taper 40, so that a straght portion 42 is formed as the leading straight portion 44 is formed in FIGS. 2*a* and 2*b*.

Figure 3:
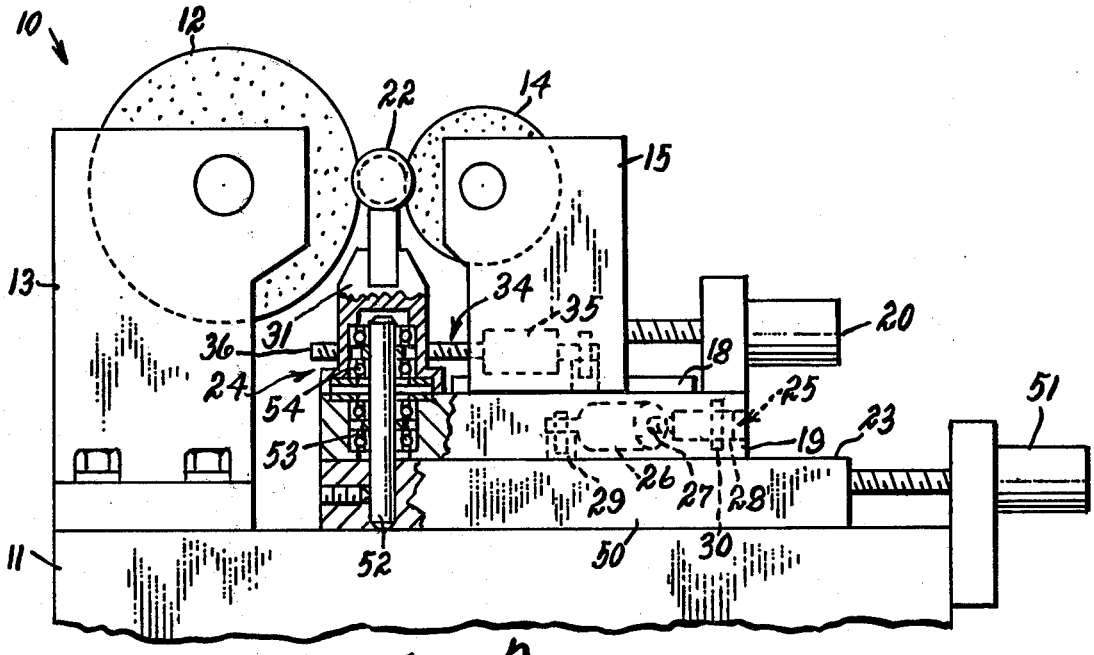
FIG. 3 is an elevational view taken in the direction of arrow 3 of FIG. 1.

FIG. 3 depicts the relative position of the machine units, where the pivot joint comprises a pivot pin 52 fixed in the wheelslide 50, and the subbase 19 and work support 31 are rotatably journaled on the pivot pin 52 by their respective bearing assemblies 53,54.

Grinding Process

The key to the grinding of tapers on relatively hard (for example, steel) is to provide a machine and method that permit the full use of the wheel width while the diameter-producing portion of the wheels is closing and opening to follow the taper. The potential efficiency of a thrufeed centerless operation applied to high production grinding is directly proportional to the width of the grinding wheel and the horsepower available to put the full wheel to work. However, the realization of that potential can be compromised by the greater time required to true the wider wheels, unless wheels are used that are "self-dressing".

In order to use self-dressing wheels, there is one basic rule that must be respected: the grinding operation must be such that the metal removal is uniformly spread across the working width of the wheel by the self-regulating effect of the volumetric wheel wear being directly related to the volume of metal removed.

On a straight-bar grinding operation, the mechanism of this self-dressing process is easy to understand, but on the tapered-bar grinder, it is much less evident. FIGS. *2a–2g* show the relative swivel infeed rates as the bars feed through the wheels, with "K" representing the metal removal rate.

In FIG. *2a*, "K"-value is a constant; FIGS. *2b* and *2c*, "K"-value is decreasing along the wheel from the inlet end 16 to the exit end 17; FIGS. *2d* and *2e*, "K"-value constant; FIG. *2f*, "K"-value increasing along the wheels from the inlet end 16 to the outlet end 17.

The metal removal rate across the grinding wheel is composed of two element of the process. One is the average taper between the wheels, which, when combined with the thrufeed rate, determines the average specific metal removal rate. If this taper were fixed, the wheel/work contact line would, by the effect of the self-dressing wheel, adjust itself to spread the metal removal uniformly across the wheel. However, since the second element of the metal removal rate is a dynamic element, with the rate changing from front to rear of the wheels, there will be a difference in wear rate along the cutting width, resulting in a change of shape of the wheels. However, since many of the tapered bars encountered to be ground are perfectly symmetrical (the same taper on each end), the infeed movement necessary to grind the taper on the outgoing end of the bar would cause the wheel to wear faster at the rear, but the outfeed movement necessary to grind the increasing diameter on the incoming end of the bar would reduce the wear on the wheel at that point. The resulting wear would then be the average of the two, or the same as if there were no swivel movement, and the wheel would wear uniformly across its width.

Even if bars had to be ground that had a taper on only one end, it would be possible to use the swivel infeed on the outgoing end of the first bar and the outfeed on the incoming end of the alternate bar; in other words, a complete infeed and outfeed cycle for each two bars would give the same average metal removal across the face of the wheel, causing it to wear uniformly and maintain the same profile throughout the wear life.

While the workpiece is being shown formed from a solid, it may be appreciated that it is preferable to have large amounts of stock previously roughed out of the work stock, so that a "preformed" rough workpiece will be entering at the wheels 12,14 of FIG. *2a*. It can further be appreciated that during the high production rates associated with through feed grinding on a centerless grinder, additional workpieces may be flowing into the inlet end 16 of the wheels 12,14, as a prior workpiece 22 is exiting the wheels.

It is not intended to limit the invention to the specific drawing and description contained herein, but rather that the invention encompases all such designs and modifications as come within the scope of the appended claims.

What is claimed is:

1. A centerless grinder, comprising in combination:

(a) a base;

(b) a grinding wheel, rotatably journaled in a grinding wheelhead on said base;

(c) a regulating wheel, rotatably journaled in a regulating wheelhead on said base and disposed relative to said grinding wheel so as to form an inlet end and an outlet end between said wheels;

(d) a work support located between said wheels, adapted to support a workpiece of revolution;

(e) a pivot joint proximate to said inlet end;

(f) means to pivot one of said regulating wheel and said grinding wheel relative to the other, about said pivot joint, while grinding;

(g) means to axially move said workpiece relative to said wheels while grinding; and (h) pivot feed means operable to achieve variable feed distances along the face of said regulating wheel relative to said grinding wheel, from said inlet end to said outlet end, while grinding.

2. The centerless grinder of claim 1, wherein said pivot feed means provides relative wheelhead feed through predetermined wheelhead angular positions about said pivot joint, and further comprises:

(i) work support positioning means operable to bisect predetermined angles formed by said grinding wheel and said regulating wheel.

3. The centerless grinder of claim 2, wherein said means to axially move said workpiece includes means to continuously move said workpiece while grinding.

4. A method of grinding a workpiece on a centerless grinder comprising the following steps:

(a) supporting and rotating a workpiece of revolution between regulating and grinding wheels;

(b) continuously moving said workpiece in an axial direction while grinding; and (c) pivoting one of said regulating and grinding wheels relative to the other, about a pivot joint proximate a workpiece inlet end between said wheels, while grinding.

5. The grinding method of claim 4, further comprising the following steps:

(d) pivoting said workpiece about a pivot axis in said pivot joint, bisecting the angle formed between said regulating and grinding wheels, while grinding.

* * * * *